US008517121B2

(12) United States Patent
Downton

(10) Patent No.: US 8,517,121 B2
(45) Date of Patent: Aug. 27, 2013

(54) STEERABLE DRILLING SYSTEM

(75) Inventor: Geoffrey C. Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 467 days.

(21) Appl. No.: 12/809,861

(22) PCT Filed: Dec. 16, 2008

(86) PCT No.: PCT/US2008/086987
§ 371 (c)(1),
(2), (4) Date: Nov. 4, 2010

(87) PCT Pub. No.: WO2009/085753
PCT Pub. Date: Jul. 9, 2009

(65) Prior Publication Data

US 2011/0042144 A1 Feb. 24, 2011

(30) Foreign Application Priority Data

Dec. 21, 2007 (GB) ..... 0724900.6

(51) Int. Cl.
*E21B 7/08* (2006.01)

(52) U.S. Cl.
USPC ..... 175/74; 175/61; 175/73

(58) Field of Classification Search
USPC ..... 175/61, 73, 74, 76
See application file for complete search history.

(56) References Cited

U.S. PATENT DOCUMENTS

| | | | | |
|---|---|---|---|---|
| 3,068,946 | A * | 12/1962 | Frisby et al. | 175/73 |
| 3,667,556 | A | 6/1972 | Henderson | |
| 5,390,153 | A * | 2/1995 | Scherbatskoy | 367/83 |
| 6,092,610 | A | 7/2000 | Kosmala et al. | |
| 6,216,802 | B1 * | 4/2001 | Sawyer | 175/73 |
| 6,234,259 | B1 * | 5/2001 | Kuckes et al. | 175/73 |
| 6,863,443 | B2 * | 3/2005 | Mahling | 384/536 |
| 2003/0127252 | A1 * | 7/2003 | Downton et al. | 175/73 |
| 2005/0098350 | A1 * | 5/2005 | Eppink et al. | 175/26 |
| 2008/0086987 | A1 | 4/2008 | Lucas et al. | |
| 2010/0025115 | A1 | 2/2010 | Kotsonis et al. | |

FOREIGN PATENT DOCUMENTS

| | | |
|---|---|---|
| EP | 1857631 | 11/2007 |
| GB | 2399121 | 9/2004 |
| WO | 03/052236 | 6/2003 |
| WO | 2009/085753 | 7/2009 |

OTHER PUBLICATIONS

Office action for the equivalent Chinese patent application No. 200880127109.4 issued on Aug. 3, 2012.

* cited by examiner

*Primary Examiner* — William P Neuder
*Assistant Examiner* — Richard Alker
(74) *Attorney, Agent, or Firm* — Chadwick A. Sullivan

(57) ABSTRACT

A steerable drilling system comprising a bottom hole assembly (18) including an upper section (22) and a steering section (24), a swivel (26) permitting adjustment of the orientation of an axis of the steering section (24) relative to that of the upper section (22), a downhole motor operative to drive the steering section (24) for rotation relative to the upper section (22), and a plurality of actuators (34) operable to control the orientation of the axis of the steering section (24) relative to that of the upper section (22), the (actuators 34) being mounted upon one of the steering section (24) and the upper section (22,) a high speed sliding contact being formed between the actuators (34) and the other of the steering section (24) and the upper section (22).

18 Claims, 2 Drawing Sheets

STEERABLE DRILLING SYSTEM

This invention relates to a steerable drilling system for use in the formation of boreholes for example for subsequent use in the extraction of hydrocarbons.

GB 2399121 describes a steerable drilling system in which a bottom hole assembly incorporates a swivel or universal joint located between an upper section and a steering section thereof. A downhole motor is located in the upper section and drives a drill bit carried by the steering section for rotation. A series of pistons are provided on the upper section, the pistons being operable to adjust the angle of the axis of the steering section relative to that of the upper section.

It is an object of the invention to provide a steerable drilling system of this general type and which is of simple and convenient form.

According to the present invention there is provided a steerable drilling system comprising a bottom hole assembly including an upper section and a steering section, a swivel permitting adjustment of the orientation of an axis of the steering section relative to that of the upper section, a downhole motor operative to drive the steering section for rotation relative to the upper section, and a plurality of actuators operable to control the orientation of the axis of the steering section relative to that of the upper section, the actuators being mounted upon one of the steering section and the upper section, and arranged to act against the other of the steering section and the upper section.

A high speed sliding contact may be formed between the actuators and the said other of the steering section of the upper section.

The high speed sliding contact may form a hydrodynamic bearing, thereby avoiding excessive wear of the actuators and/or surfaces contacted thereby.

The actuators preferably comprise pistons, for example arranged to be driven using drilling fluid or mud. Fluid may be supplied through the pistons to lubricate the contact between the pistons and the said other of the steering section and the upper section.

Alternatively, a rolling bearing arrangement may be provided between the actuators and the said other of the steering section and the upper section. A compliant material may be incorporated into the bearing arrangement to accommodate angular movement of the steering section relative to the upper section about the swivel.

The downhole motor may take a range of forms. For example it may comprise a drilling fluid or mud powered motor, a turbine, or an electrically powered motor.

The invention will further be described, by way of example, with reference to the accompanying drawings, in which.

Figure 1:
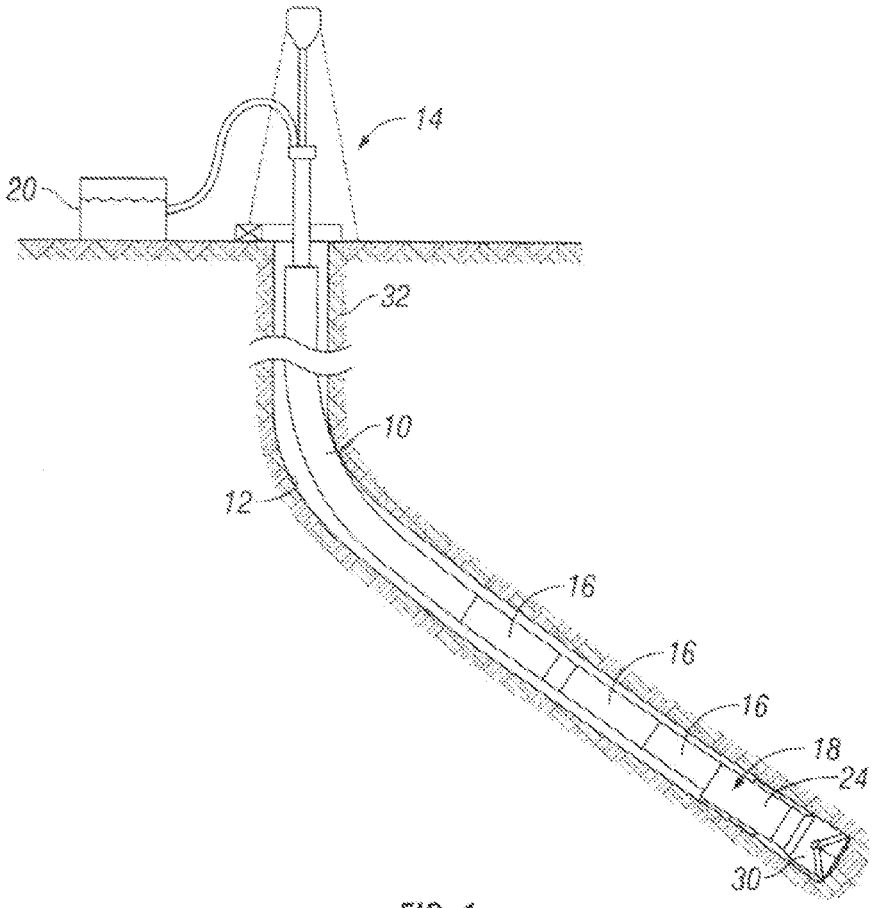
FIG. 1 illustrates a drilling rig incorporating a steerable drilling system according to one embodiment of the invention.

The drilling rig illustrated in FIG. 1 comprises a drill string 10 supported within a wellbore 12 by a surface located arrangement 14. The drill string 10 carries a series of stabilisers 16 and other components, and at its lower end is connected to and supports a bottom hole assembly 18. The surface located arrangement 14 is arranged to rotate the drill string 10 and the components secured thereto, and is also arranged to supply drilling fluid 20 along the drill string 10 to components located downhole.

Figure 2:
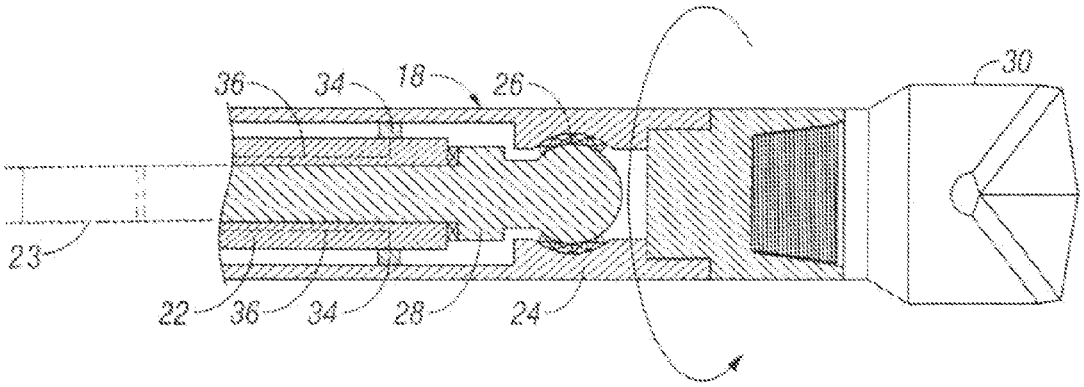
FIG. 2 is a view illustrating the steerable drilling system of FIG. 1.

The bottom hole assembly 18 is illustrated in greater detail in FIG. 2 and comprises an upper section 22 and a steering section 24. A universal joint 26 connects the steering section 24 to the upper section 22. The universal joint 26 allows the orientation of the steering section 24 to be adjusted through an angle of at least +/−2° relative to the upper section 22. The upper section 22 houses a downhole motor 23. The motor 23 may take a range of forms. For example it may comprise a drilling fluid or mud powered motor, a turbine, or an electrically powered motor. A rotor of the motor 23 is connected to an output shaft 28 which extends through and is rotatable relative to the upper section 22, the shaft 28 applying rotary drive from the downhole motor 23 through the universal joint 26 to the steering section 24. A drill bit 30 is connected to the steering section 24. It will be appreciated that the operation of the downhole motor 23 results in the drill bit 30 being driven for rotation relative to the upper section 22.

In use, the upper section 22 is secured to the drill string 10 so as to be movable therewith. The operation of the drilling system is such that a weight-on-bit loading is applied via the drill string 10 to the upper section 22, the weight-on-bit loading being transmitted via the universal joint 26 to the steering section 24 and hence to the drill bit 30. The application of the weight-on-bit loading in combination with the rotation of the drill bit 30 due to the operation of the downhole motor and due to the rotation of the drill string 10 resulting in the bit 30 gouging, scraping or otherwise removing material from the formation 32 in which the borehole 12 is being formed, thus extending the length of the borehole 12.

A plurality of actuators 34 are mounted upon the upper section 22, the actuators 34 being arranged to engage with part of the steering section 24 and being operable to control the position or orientation of the axis of the steering section 24 relative to that of the upper section 22. It will be appreciated that as the actuators 34 are mounted upon the part of the upper section 22 which is rotatable with the drill string 10, and the actuators 34 bear against a part of the steering section 24 which is driven by the operation of the downhole motor, there will be a high speed sliding contact between the actuators 34 and the steering section 24, in use. The high speed sliding contact results in the formation of a hydrodynamic bearing which serves to minimise wear of the actuators 34 and associated part of the steering section 24.

The actuators 34 take the form of a series of pistons which are supplied with fluid under pressure, in use, along supply lines 36 provided in the upper section 22. The supply of fluid along the supply lines 36 is conveniently controlled using, for example, a rotary valve or a series of bi-stable actuator valves which may be located either above or below the downhole motor.

Although not illustrated, the bottom hole assembly 18 will incorporate flow passage means whereby drilling fluid can be supplied through the bottom hole assembly 18 to the drill bit 30 to be delivered from flow passages or nozzles formed therein. For example, this may be achieved by supplying the fluid along a passage formed in the shaft 28 and through a flexible pipe which passes through the universal joint 26 to the steering section 24. The drilling fluid so supplied serves to wash cut formation material away from the drill bit 30, the drilling fluid and cut material tending to flow back along the borehole 12 along the annulus formed between the drill string 10 and the wall of the borehole 12 to the surface or another suitable location, thereby carrying the cut material away from the drill bit 30.

Steering may be achieved using a couple of different techniques, as described in GB 2399121. In one technique, the actuators 34 are controlled so as to keep the tool face of the drill bit 30 in a desired orientation, or pointing is a desired direction, whilst the motor is operated to drive the drill bit 30 for rotation and a weight on bit loading is applied as described hereinbefore. As, during this operation, the drill string 10 may be rotating continuously or intermittently, it will be appreciated that the actuators 34 may require continuous or periodic adjustment to ensure that the steering section 24 is held in the desired orientation. Where a relatively straight section of borehole is required, the actuators 34 may be operated to hold the steering section 24 and the upper section 22 substantially coaxially with one another. However, even in this mode of operation it is likely that the section of borehole formed will deviate from being truly straight, for example due to the drill bit 30 moving through layers of different types of formation material.

As with the arrangements described in GB 2399121, stabilisers may be mounted upon or associated with the upper section and/or the steering section, the position of the stabilisers determining, to some extent, the types of steering technique which can be used. Where a stabiliser is provided on the steering section, it may be located above, on or beneath the location of the centre of the universal joint.

Angle sensors (not shown) may be provided to allow sensing of the angle of the steering section 24 relative to the upper section 22, and thereby permit measurements to be taken of the direction in which the bit is pointed. This information may be used in a feedback loop, controlling the operation of the drilling system. The angle sensors could be of inductive form, for example comprising coils mounted upon the steering section 24 and non-co-planar sensors located on the upper section 22, or vice versa.

A cable or wire may extend along the length of the rotor and shaft 28 to allow electrical connection to, for example, sensors located on the drill bit 30. Slip rings or inductive couplings may be provided to permit connections to be made to the cable or wire. The cable or wire may be used to energize the sensors and/or transmit signals therefrom.

Although the arrangement illustrated and described hereinbefore makes use of actuators 34 in the form of pistons located above the universal joint 26, it may be possible to locate some or all of the actuators 34 below the position of the universal joint 26 and/or at different distances from the universal joint 26. By staggering the positions of the actuators 34, the number of actuators 34 provided may be increased without unnecessarily increasing the diameter of the bottom hole assembly 18.

In another embodiment, rather than mount the actuators 34 upon the part of the upper section 22 which is rotatable with the drill string 10, the actuators 34 may be mounted upon the steering section 24 to be rotatable therewith, the actuators 34 bearing against parts of the upper section 22 in use.

Figure 3:
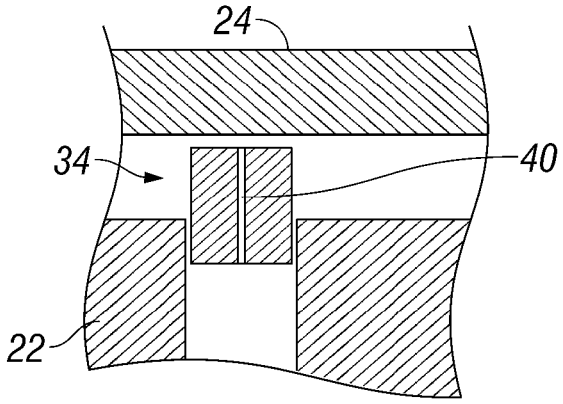
FIGS. 3 to 5 illustrate alternative arrangements.

FIG. 3 illustrates a modification in which the actuators 34 are in the form of pistons and provide flow passages 40 whereby a quantity of the fluid used to control the operation of the actuators 34 is supplied to the points of contact with the steering section 24, thereby lubricating the high speed sliding contact therebetween and enhancing the hydrodynamic bearing effect.

Figure 4:
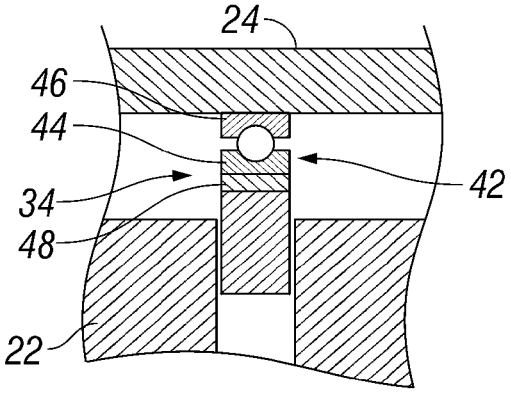

FIG. 4 illustrates a variant in which the high speed sliding bearing is replaced by a roller bearing 42 including an inner race 44 carried by the actuators 34, and an outer race 46 mounted upon the steering section 24. A compliant material element 48 may also be incorporated in the bearing 42 to accommodate the angular movement of the steering section 24 about the universal joint 26.

Figure 5:
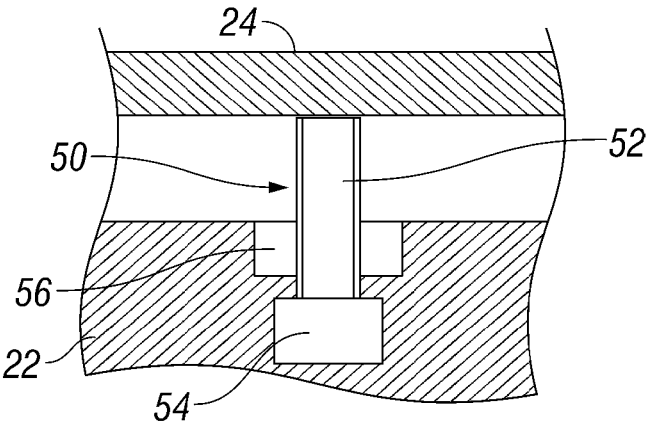

In each of the arrangements described hereinbefore, rather than use pistons as the actuators 34, lead screw arrangements 50 could be used as shown in FIG. 5. The arrangements 50 each include a screw 52 rotatable by a motor 54 and in engagement with a threaded sleeve 56 such that operation of the motor 54 extends or retracts the screw 52. Roller bearings or sliding bearings may be used as described hereinbefore.

Although the use of lead screw arrangements is likely to have a slower response speed than a hydraulically driven arrangement, where mounted on the upper sleeve and used in arrangements in which the upper sleeve rotates fairly slowly, the response speed may be adequate, and the power used to adjust the steering section orientation could be very low. Such an arrangement may be particularly beneficial in high temperature applications.

Another possibility involves using hydraulic oil to move actuator pistons, the oil being supplied by, for example, a low power pump.

In all of the arrangements described hereinbefore it will be appreciated that, by locating the actuators on the upper sleeve, they only need to be actuated in normal use in time with the rotation of the upper sleeve rather than at bit speed, thus considerable power savings can be made.

It will be appreciated that a wide range of modifications and alterations may be made to the arrangement described hereinbefore without departing from the scope of the invention.

The invention claimed is:

1. A steerable drilling system comprising a bottom hole assembly including an upper section and a steering section for rotating a drill bit, a swivel permitting adjustment of the orientation of an axis of the steering section relative to an axis of the upper section, a downhole motor operative to drive the steering section for rotation relative to the upper section, and a plurality of actuators positioned around the upper section and within the steering section, the plurality of actuators being operable to control the orientation of the axis of the steering section relative to the axis of the upper section, the actuators being mounted upon one of the steering section and the upper section, and being arranged to act in a radial direction against the other of the steering section and the upper section.

2. A system according to claim 1, wherein a high speed sliding contact is formed between the actuators and the said other of the steering section and the upper section.

3. A system according to claim 1, wherein a roller bearing arrangement is provided between the actuators and the said other of the steering section and the upper section.

4. A system according to claim 3, wherein the roller bearing arrangement incorporates a compliant material element.

5. A system according to claim 1, wherein the actuators comprise pistons.

6. A system according to claim 5, wherein the pistons define flow passages.

7. A system according to claim 1, wherein the actuators include lead screw arrangements.

8. A system according to claim 1, wherein the actuators are aligned with one another at a common distance from the swivel.

9. A system according to claim 1, wherein the swivel is adapted to permit the transmission of a weight on bit loading to the steering section.

10. A system according to claim 1, wherein the motor comprises one of a mud motor, a turbine and an electrically powered motor.

11. A system according to claim 1, further comprising a stabilizer mounted on the steering section.

12. A method for steering during drilling of a wellbore, comprising:

providing a bottom hole assembly with an upper section and a steering section;

connecting the upper section and the steering section with a swivel which permits adjustment of the orientation of an axis of the steering section relative to an axis of the upper section;

using a downhole motor to drive the steering section for rotation relative to the upper section during drilling of the wellbore; and controlling the orientation of the axis of the steering section relative to the axis of the upper section with a plurality of actuators positioned around the upper section and within the steering section to act in a radial direction between the steering section and the upper section.

13. The method according to claim 12, further comprising forming a high-speed sliding contact between the plurality of actuators and one of the steering section and the upper section.

14. The method according to claim 12, further comprising utilizing a flexible pipe to provide a supply of fluid through the universal joint to the steering section.

15. The method according to claim 14, further comprising utilizing a valve system to control the supply of fluid to the plurality of actuators.

16. The method according to claim 15, wherein utilizing comprises utilizing a rotary valve.

17. The method according to claim 15, wherein utilizing comprises utilizing at least one bistable valve.

18. The method according to claim 12, further comprising employing an angle sensor to sense the angle of the steering section relative to the upper section.

* * * * *